US006778881B1

(12) United States Patent
Du Plessis et al.

(10) Patent No.: US 6,778,881 B1
(45) Date of Patent: Aug. 17, 2004

(54) MONITORING AND CONTROL OF A FROTH FLOTATION PLANT

(75) Inventors: Francois Eberhardt Du Plessis, Stellenbosch (ZA); Marc Van Olst, Benoni (ZA)

(73) Assignee: Outokumpu Oyj, Espoo (FI)

( * ) Notice: Subject to any disclaimer, the term of this patent is extended or adjusted under 35 U.S.C. 154(b) by 88 days.

(21) Appl. No.: 10/130,314

(22) PCT Filed: Nov. 23, 2000

(86) PCT No.: PCT/IB00/01734

§ 371 (c)(1),
(2), (4) Date: Jul. 8, 2002

(87) PCT Pub. No.: WO01/38001

PCT Pub. Date: May 31, 2001

(30) Foreign Application Priority Data

Nov. 24, 1999 (ZA) ..... 99/7295

(51) Int. Cl.[7] ..... B03D 1/14

(52) U.S. Cl. ..... 700/265; 209/166; 209/168; 209/901; 209/902; 210/221.1; 210/745; 252/61

(58) Field of Search ..... 700/265, 266; 209/901, 902, 166, 168; 210/221.1, 745; 252/61; 356/442

(56) References Cited

U.S. PATENT DOCUMENTS 4,731,176 A * 3/1988 Macdonald ..... 209/166
6,727,990 B1 * 4/2004 Niemi ..... 209/168

* cited by examiner

*Primary Examiner*—Leo Picard
*Assistant Examiner*—Charles Kasenge
(74) *Attorney, Agent, or Firm*—Smith-Hill and Bedell

(57) ABSTRACT

The invention uses machine-vision to improve the performance of a flotation operation to provide a substitute for conventional human vision and problem-solving abilities. The invention redirects the conventional approach of "characterizing the froth" to "measuring the froth characteristic." The invention provides a method of monitoring and controlling a mineral mixture flow in a froth flotation cell of a flotation plant which includes the steps of obtaining a series of digital images extracted of froth characteristics from a flotation cell. The digital images are transmitted to a computer for processing thereof into parameter signals of digital parameter froth characteristics. Control signals are produced in response to parameter signals received for causing required variations in froth characteristics in a flotation cell; and the froth characteristics in the flotation cell are controlled in response to the control signals so as to cause required variations in the froth characteristics in the cell.

27 Claims, 5 Drawing Sheets

MONITORING AND CONTROL OF A FROTH FLOTATION PLANT

FIELD OF INVENTION

The present invention relates to monitoring and control of a froth flotation plant.

BACKGROUND TO INVENTION

In a flotation plant for mineral ores the flow of a mineral mixture to be processed has to be observed and controlled in order to achieve optimum separation of its constituents. For this purpose froth speed, bubble size and stability are important factors.

Since the early days of flotation, process technicians have known that the speed at which the froth is recovered over the lip of a flotation cell has a very direct and consistent influence on the grade and recovery of the circuit. One of the most important aspects of a process technician's job is ensuring is that the froth is moving at a desired and controlled speed over the lip. Unfortunately, process technicians cannot watch the froth throughout an entire shift, as there are always other problems to attend to.

A considerable amount of work has been done in order to improve control of flotation, for instance by automatically measuring the speed of the froth. This measurement would then be used in simple controllers to emulate the steps taken by the process technician in correcting deviations of the froth speed from its desired level. Many of the earlier attempts to measure speed were ineffective, as they were unable to cope with turbulence of the froth surface.

It is an object of the invention to suggest monitoring and control means, which will result in improved monitoring and control of a froth flow in a flotation plant.

SUMMARY OF INVENTION

According to the invention, there is provided a monitoring arrangement for a froth flotation cell of a flotation plant, which arrangement includes an optical observation means adapted to observe digitally a series of images to extract froth characteristics in a mineral mixture flow in a froth flotation cell of a flotation plant and being further adapted to emit corresponding digital image signals; a computer for processing digital image signals received from the optical observation means and being adapted to emit parameter signals of calculated parameters of froth characteristics; digital image transmitting means adapted for transmitting digital image signals from the optical observation means to the computer; display means for displaying parameter signals received from the computer; and parameter signal transmitting means adapted for transmitting parameter signals from the computer to the display means.

Also according to the invention, there is provided a monitoring and control arrangement for a froth flotation cell of a flotation plant, which arrangement includes an optical observation means adapted to observe digitally a series of images to extract froth characteristics in a mineral mixture flow in a froth flotation cell of a flotation plant and being further adapted to emit corresponding digital image signals; a computer for processing digital image signals received from the optical observation means and being adapted to emit parameter signals of calculated parameters of froth characteristics and being further adapted to produce control signals in response to parameter signals received for causing required variations in froth characteristics in a froth flotation cell; digital image transmitting means adapted for transmitting digital image signals from the optical observation means to the computer; control means for controlling froth characteristics in a froth flotation cell; and control signal transmitting means adapted for transmitting control signals from the computer to the control means for causing required variations in froth characteristics in a froth flotation cell.

Further according to the invention, a monitoring and control arrangement for a froth flotation cell of a flotation plant arrangement includes an optical observation means adapted to observe digitally a series of images to extract froth characteristics in a mineral mixture flow in a froth flotation cell of a flotation plant and being further adapted to emit corresponding digital image signals; a computer for processing digital image signals received from the optical observation means and being adapted to emit parameter signals of calculated parameters of froth characteristics and being further adapted to produce control signals in response to parameter signals received for causing required variations in froth characteristics in a froth flotation cell; digital image transmitting means adapted for transmitting digital image signals from the optical observation means to the computer; display means for displaying calculated parameter froth characteristic signals received from the computer; parameter signal transmitting means adapted for transmitting parameter signals from the computer to the display means; control means for controlling froth characteristics in a froth flotation cell; and control signal transmitting means adapted for transmitting control signals from the computer to the control means for causing required variations in froth characteristics in a froth flotation cell.

Yet further according to the invention, a method of monitoring a mineral mixture flow in a froth flotation cell of a flotation plant includes the steps of obtaining a series of digital images extracted of froth characteristics from a flotation cell of a flotation plant; of transmitting the digital images to a computer for processing thereof; of processing the digital images in the computer into parameter signals of digital parameter froth characteristics; and of transmitting the parameter signals to a display means for displaying the digital parameter froth characteristics obtained.

Further according to the invention, a method of monitoring and controlling a mineral mixture flow in a froth flotation cell of a flotation plant includes the steps of obtaining a series of digital images extracted of froth characteristics from a flotation cell of a flotation plant; of transmitting the digital images to a computer for processing thereof; of processing the digital images in the computer into parameter signals of digital parameter froth characteristics; of producing control signals in response to parameter signals received for causing required variations in froth characteristics in a froth flotation cell; and of controlling the froth characteristics in the flotation cell in response to the control signals so as to cause required variations in the froth characteristics in the cell.

Further according to the invention, a method of monitoring and controlling of a mineral mixture flow in a froth flotation cell of a flotation plant includes the steps of obtaining a series of digital images extracted of froth characteristics from a flotation cell of a flotation plant; of transmitting the digital images to a computer for processing thereof; of processing the digital images in the computer into parameter signals of digital parameter froth characteristics; of transmitting the parameter signals to a display means for displaying the digital parameter froth characteristics obtained; of producing control signals in response to parameter signals received for causing required variations in froth characteristics in a froth flotation cell; and of controlling the froth characteristics in the flotation cell in response to the control signals so as to cause required variations in the froth characteristics in the cell.

Froth characteristics may be selected from a group including froth speed, froth stability and bubble size.

The parameter signals transmitted from the computer may be converted to an analog industrial standard or to a digital industrial standard.

The calculated parameter signals transmitted from the computer may be converted to an analog or digital industrial standard, like 4–20 mA, 0–10V, or Fieldbus (for example Profibus or Modbus).

BRIEF DESCRIPTION OF DRAWINGS

The invention will now be described by way of example with reference to the accompanying schematic drawings showing in.

DETAILED DESCRIPTION OF DRAWINGS

The approach adopted in accordance with the invention is based on the premise that the objective of using machine-vision to improve the performance of a flotation operation should be to provide a good substitute for conventional human vision and human problem-solving abilities. The invention thus seeks to imitate trusted human observation and wisdom. The advantage of this approach is to make it simple for the process technicians and plant personnel to understand a technology that is new to plant personnel.

The invention redirects the conventional approach of "characterising the froth" to "measuring the froth characteristics". The old approach of froth characterisation met with a great deal of opposition amongst plant personnel due to the fact that each flotation plant had different required froth characteristics and different corrective actions for different deviations to achieve the desired state of the float. On new plants that had just been commissioned, it was impossible to glean sufficient knowledge from the plant personnel in terms of the operation of the process. This made it almost impossible to develop a rules-based expert system-type solution. The inventive solution, however, makes use of simple rules to develop a system that is totally open and transparent and relatively simple for the plant personnel to develop and maintain.

For example, in a froth installation the following rules apply:

Speed Control

1. IF (speed is higher than desired speed setpoint) THEN (decrease the air) OR (decrease the pulp levels) OR (decrease frother dosage).
2. IF (speed is lower than desired speed setpoint) THEN (increase the air) OR (increase the pulp levels) OR (increase frother dosage).

Grade Control

1. IF (grade is too low) THEN (decrease speed setpoint).
2. IF (grade is too high) THEN (increase speed setpoint).

These rules are implemented in accordance with the invention via simple conventional control techniques.

The arrangement in accordance with the invention measures the froth speed, bubble size and froth stability at a very high sampling rate (>2 Hz).

The differences in the approaches taken in the prior system of "froth characterization" and the inventive system of "measurement of froth characteristics" can be summarized as follows (table 1):

TABLE 1

The differences between the two approaches to vision-based flotation control

| Prior Froth Characterisation | Inventive Froth Measurement |
|---|---|
| Many parameters | Few parameters |
| Complicated classification algorithms | Simple measurement techniques |
| Fuzzy, semantic rules base for control actions | Simple conventional control possible |
| Very reliant on deep operational knowledge | Makes use of simple operational knowledge |
| Tedious system design on each new site | System design approaching generic maturity |

Figure 1:
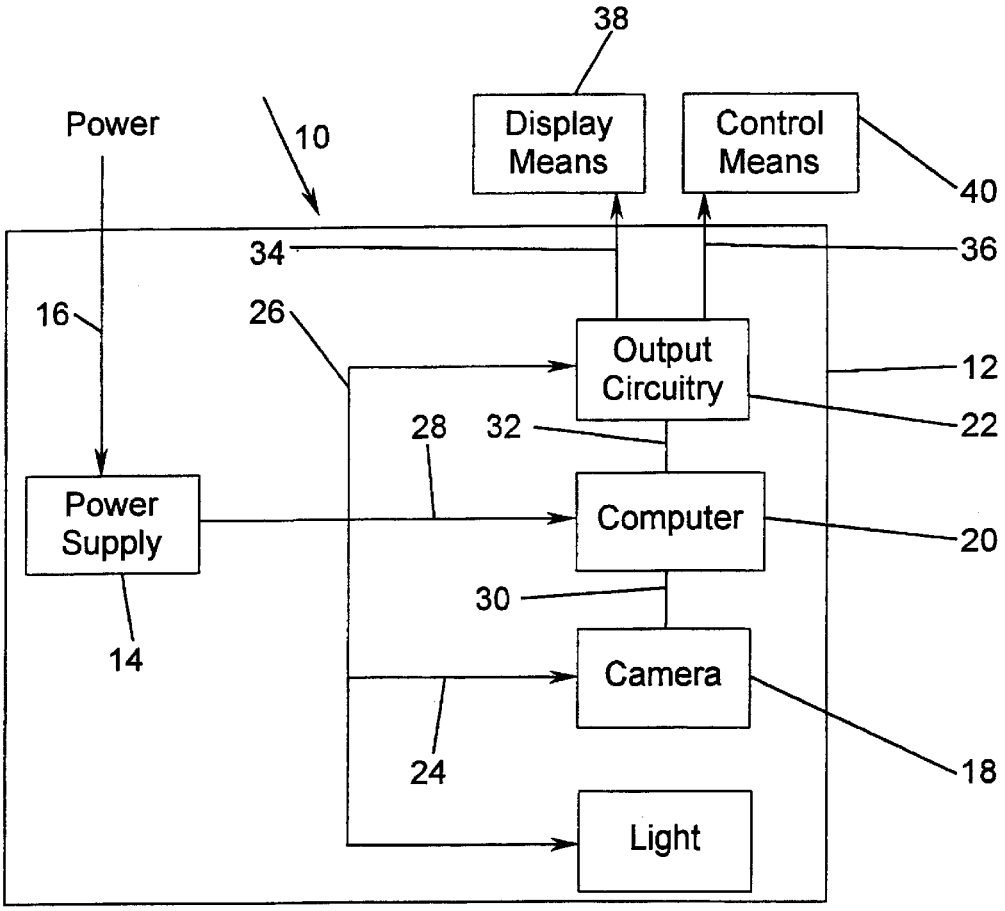
FIG. 1 a block diagram of a monitoring arrangement in accordance with the invention.

In FIG. 1 of the drawings there is shown a block diagram of a monitoring and control arrangement in accordance with the invention.

The arrangement, generally indicated by reference numeral 10, includes components housed in a housing 12, which is provided with a power supply unit 14 connected by way of conductors 16 to an external power supply, a camera 18, a computer 20, and an output circuitry 22.

The camera 18, the computer 20 and the output circuitry 22 are connected by way of conductors 24, 26, 28 to the power supply unit 14. The computer 20 is connected by way of conductors 30, 32 to the camera 18 and the output circuitry 22 respectively.

The camera 18 is adapted to take a series of images of the mineral froth in a flotation cell, which images are transferred to the computer 20 where these images are processed digitally and parameter values are calculated, the parameter values including froth speed, froth stability and bubble size.

The parameter value signals are then transferred to the output circuitry 22 which converts the parameter signals to an analog or digital industrial standard, like 4–20 mA, 0–10V or Fieldbus (for example Profibus or Modbus). These signals are then respectively transmitted as output values 34, 36 to a display 38 and to control units 40 to cause required variations in froth characteristics in the flotation cell.

Figure 2:
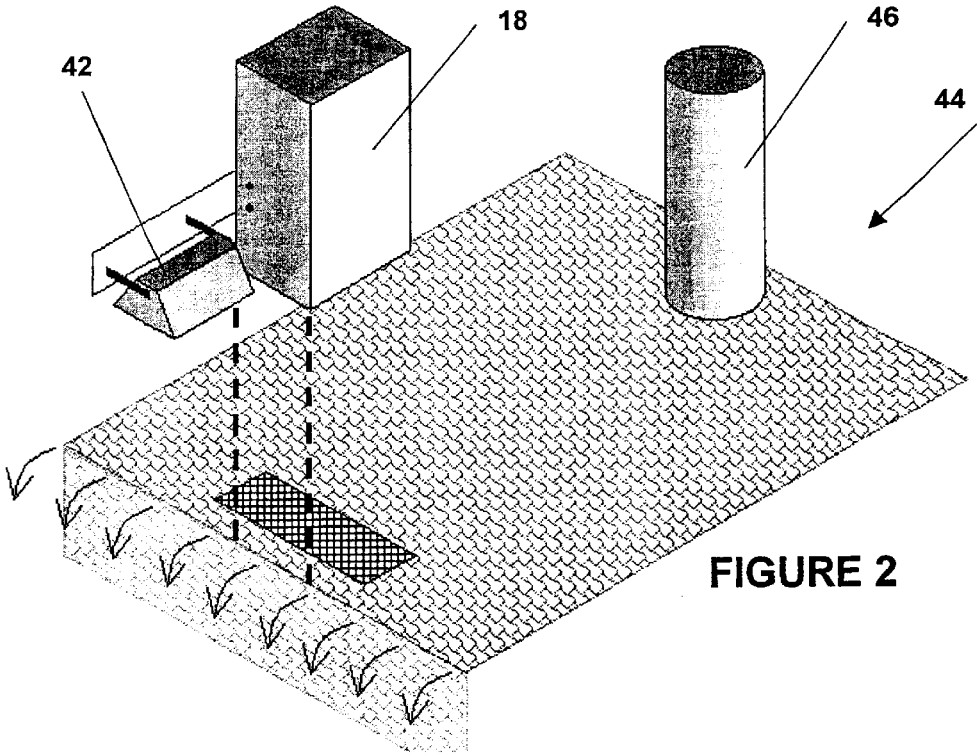
FIG. 2 a perspective view of a camera located above a flotation cell in accordance with the invention.

FIG. 2 shows a perspective view of a camera 18 and light source 42 located above a froth flotation cell 44. Also indicated is an agitator shaft 46. In use the arrangement 10 is provided with the external light source 42 (if required) and is installed at a fixed height above the froth level of the froth flotation cell 44. The arrangement 10 is connected to a mains power input and an analog output. No focus or lighting adjustments have to be made to s the arrangement 10.

During installation, an alignment frame may be used to ensure correct distance and correct region of monitoring of the arrangement.

The output values 34, 36 are used as follows:

1. The speed setpoint is determined by the desired concentrate grade to be produced by the plant in cases where there is an OSA (On-Stream Analyser). If there is no OSA, the process technician enters a speed setpoint based on his/her evaluation of the performance of the plant.
2. The measurements of the froth characteristics are received from the units in the field at the PLC (Programmable Logic Controller) or DCS (Distributed Control System) via conventional 4–20 mA analog cable.
3. The measurements are compared to the desired setpoints of the froth features (speed, bubble size and stability).
4. Based on the deviation from setpoint, the controller calculates new setpoints for the level, air and reagent dosages.
5. The plant reacts to the new setpoints of these manipulated variables and the froth features reach their desired level again.

The arrangement in accordance with the invention produces measurements of the speed of the froth as it moves from the surface of the slurry to the recovery area, the size of the bubbles in the froth and the stability of the froth. These parameters are then used as indicators of froth appearance and thus process performance. As these measurements are free from human error, they are thus consistent twenty-four hours a day, seven days a week, elevating the job of the human operator to more urgent tasks on the plant.

In tests with an arrangement in accordance with the invention the following was observed:

Controlling the Froth Speed

Figure 3:
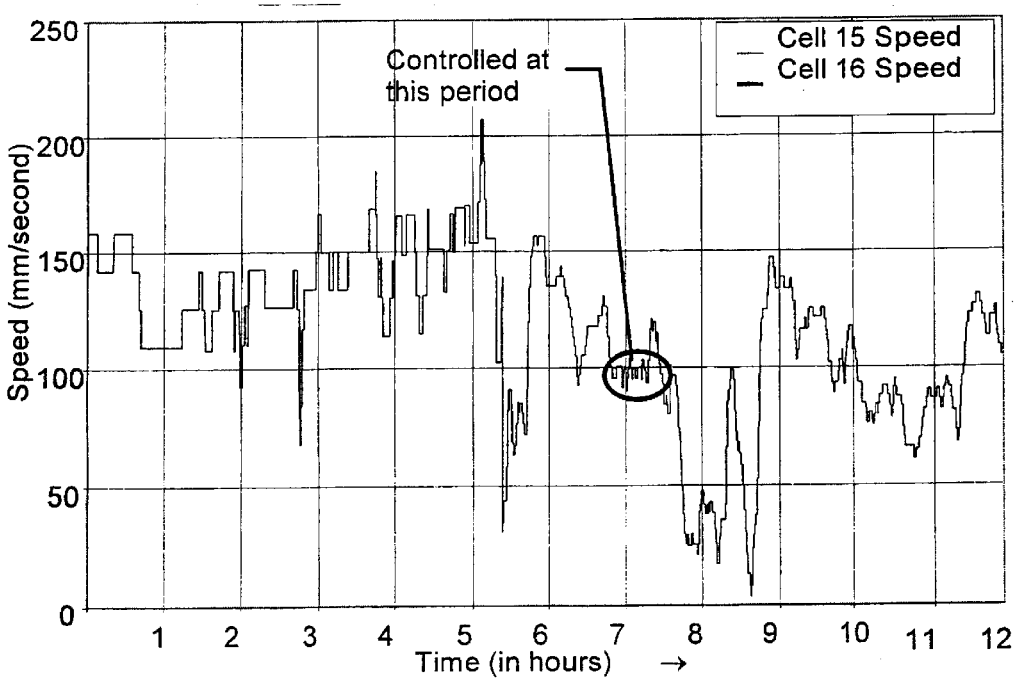
FIG. 3 the froth speed in two flotation cells over a period of four days (with moving average trend lines) before control by means of a monitoring and control arrangement in accordance with the invention.

The speed of the froth was controlled to a setpoint by using pulp or froth level, aeration rate and frother dosage as manipulated variables. The need for speed control is evidenced by FIG. 3, which shows the froth speeds from two cells on the same level. The froth speed in each cell varies considerably over time, and the speeds in the two cells do not follow each other. The net result is that the cells pull different amounts of slurry and a variable quality concentrate grade reports to the downstream plant circuit. Thus, if the speed of the froth can be controlled, the quality of concentrate obtained can be stabilized.

Figure 4:
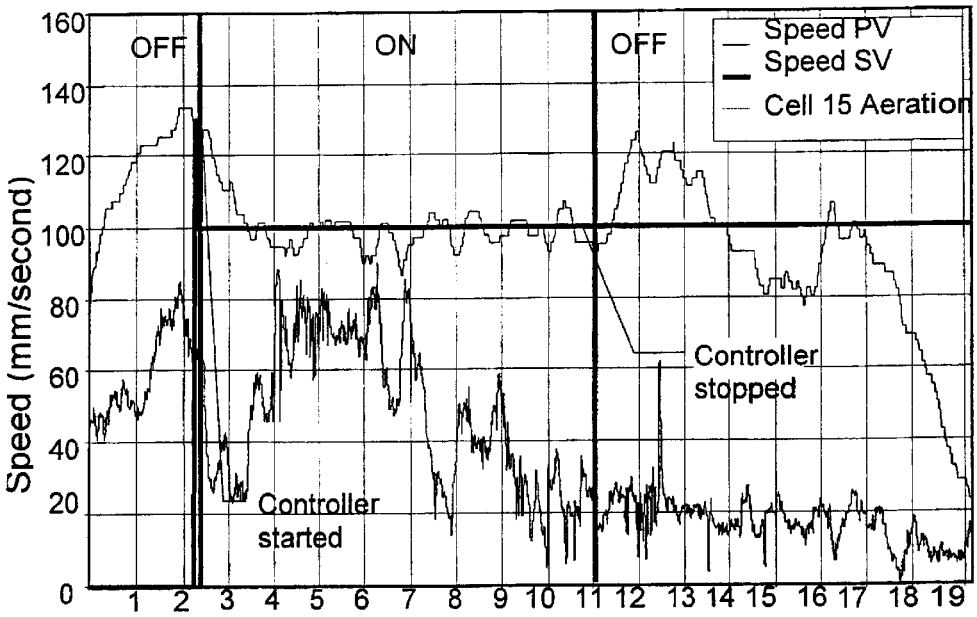
FIG. 4 results of the cascade PID (Proportional Integral Derivative) speed controller on a flotation cell.

FIG. 4 shows the result of controlling speed on a cell by varying the aeration rate. The difference in froth speed when the controller is switched on and switched off can clearly be seen. It is interesting to note how hard the manipulated variable (aeration rate) was working during this period to keep the speed constant at its setpoint. This emphasises the need for active control of the float plant.

Figure 5:
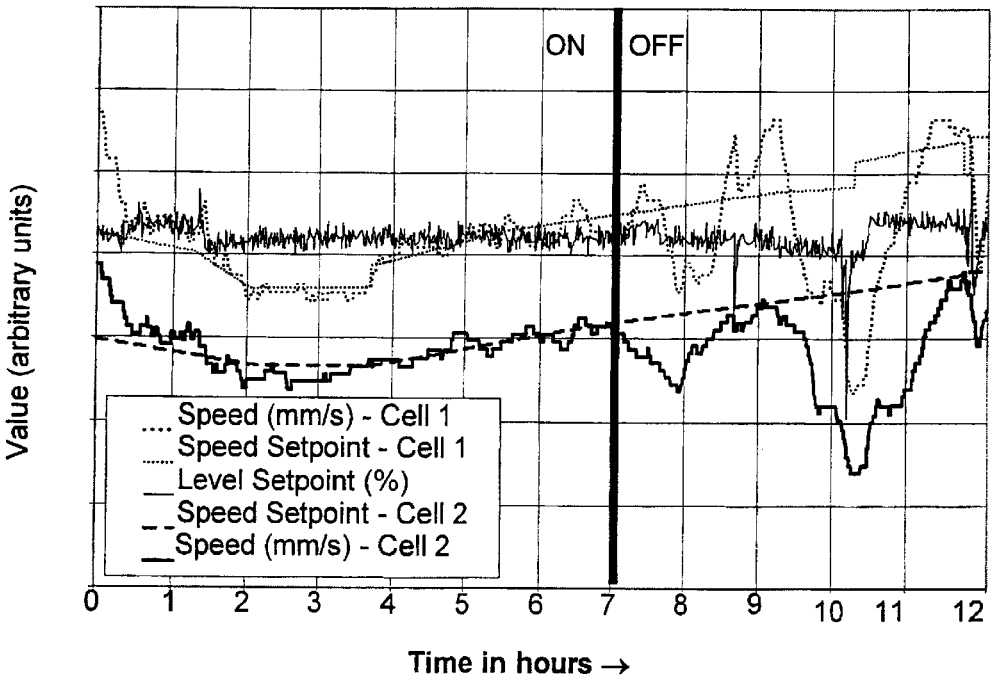
FIG. 5 the controller performance for two flotation cells over a period of 24 hours.

A controller was designed to control the speed by manipulating air, frother and level setpoints. FIG. 5 shows that the controller is able to maintain the froth speed at the set point very well, and also shows the effect on the froth speed when the controller is turned off.

Figure 6:
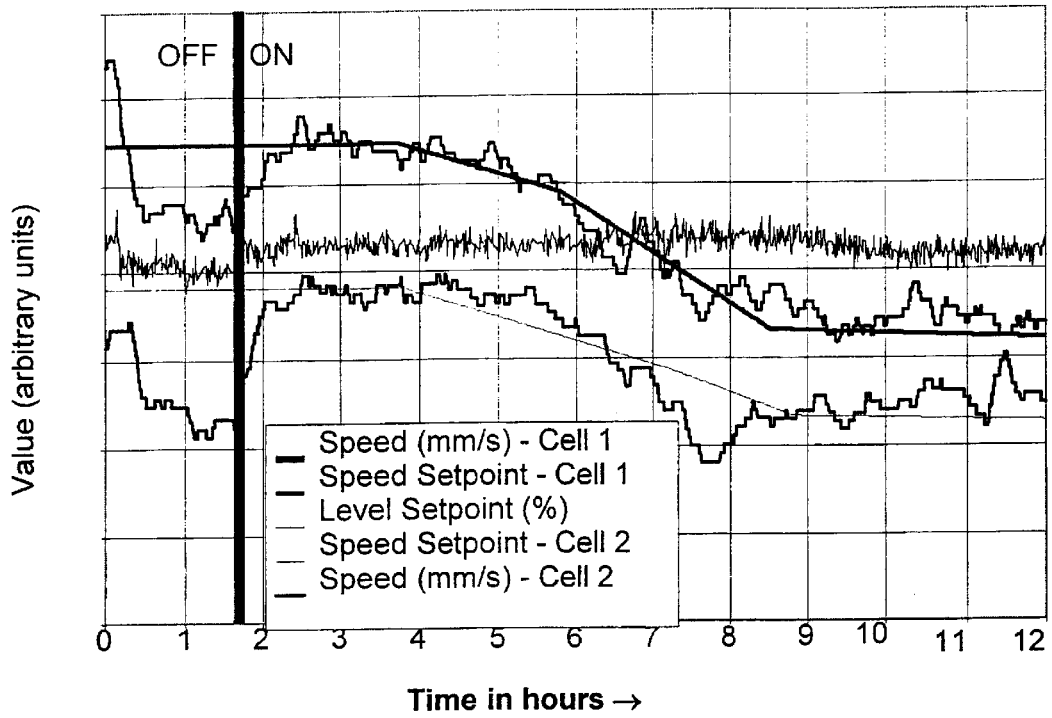
FIG. 6 the controller performance for two flotation cells over a different period of 24 hours.

Another feature of the controller is its ability to maintain a constant ratio of froth speed between two cells on the same level. This is shown in FIG. 6. Compare this to FIG. 3, which shows the uncontrolled froth speed from the two cells.

Controlling the Concentrate Grade

Achieving consistent concentrate grade is most desirable. Controlling according to a speed setpoint alone is undesirable, as different ore feeds will produce different grades for a single froth speed. To remedy this, an optimised froth speed was used to produce a constant concentrate grade. It was found that the concentrate grade is very strongly correlated to froth speed (R=0.7) rather than level (R=0.1) or aeration rate (R=0.1). settings, which are the parameters generally used to control grade. The grade information is obtained from an on-stream analyser, e.g. a commercially available COURIER analyser.

Figure 7:
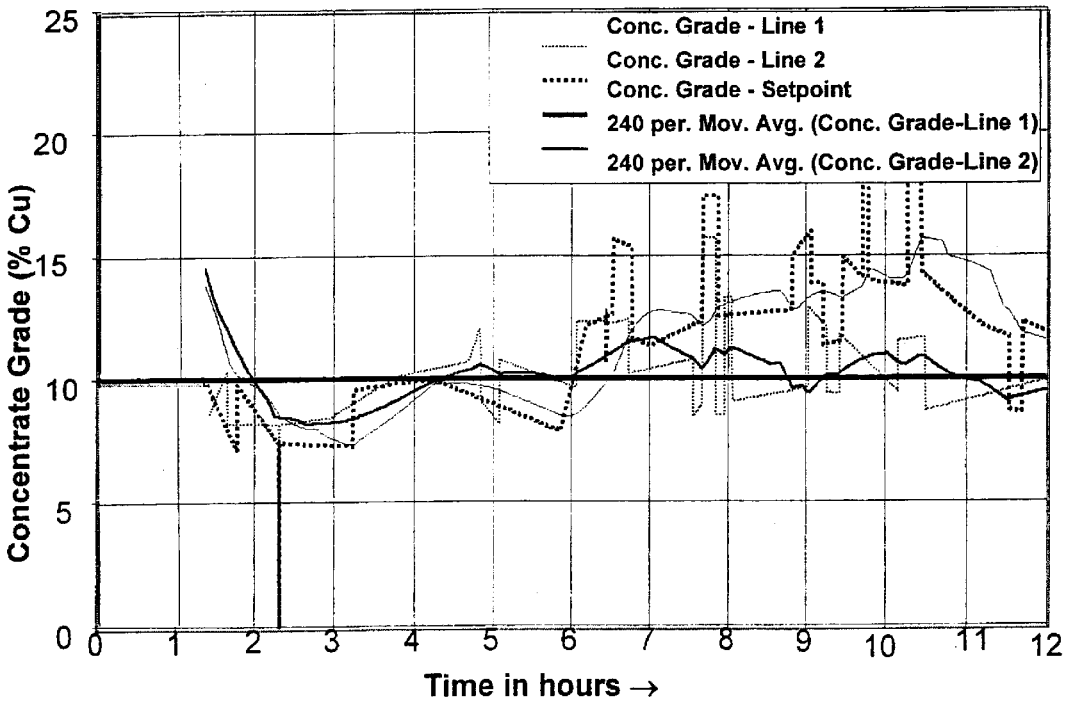
FIG. 7 the performance of the grade controller over a period of 24 hours.
Figure 8:
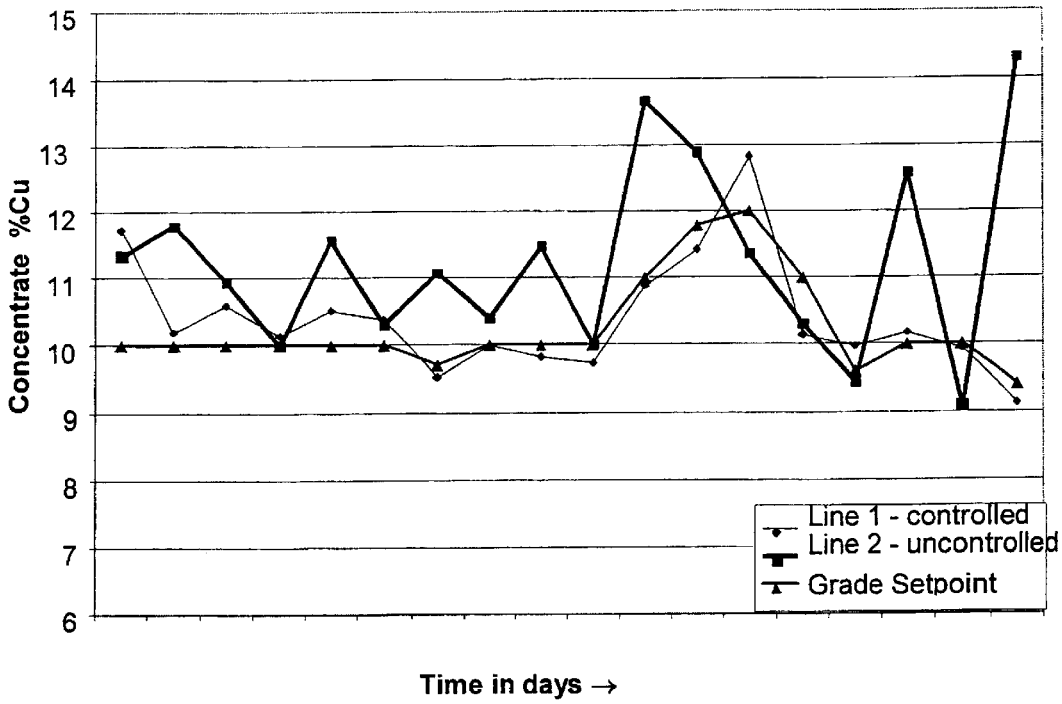
FIG. 8 the grade control vs. setpoint grade.

FIG. 7 shows the concentrate grades obtained from line 1 (controlled) and line 2 (uncontrolled). The grade from line 1 is more tightly controlled to the setpoint than line 2's grade. These results are from controlling two of the four cells producing the first rougher concentrate, and should improve further if the other two cells are equipped with arrangements in accordance with the invention. An arrangement in accordance with the invention was placed on cell 3 in line 1, and this resulted in improved grade control, as is shown in FIG. 8, which is a plot of grades from the two lines over several days.

Improving the Recovery

Figure 9:
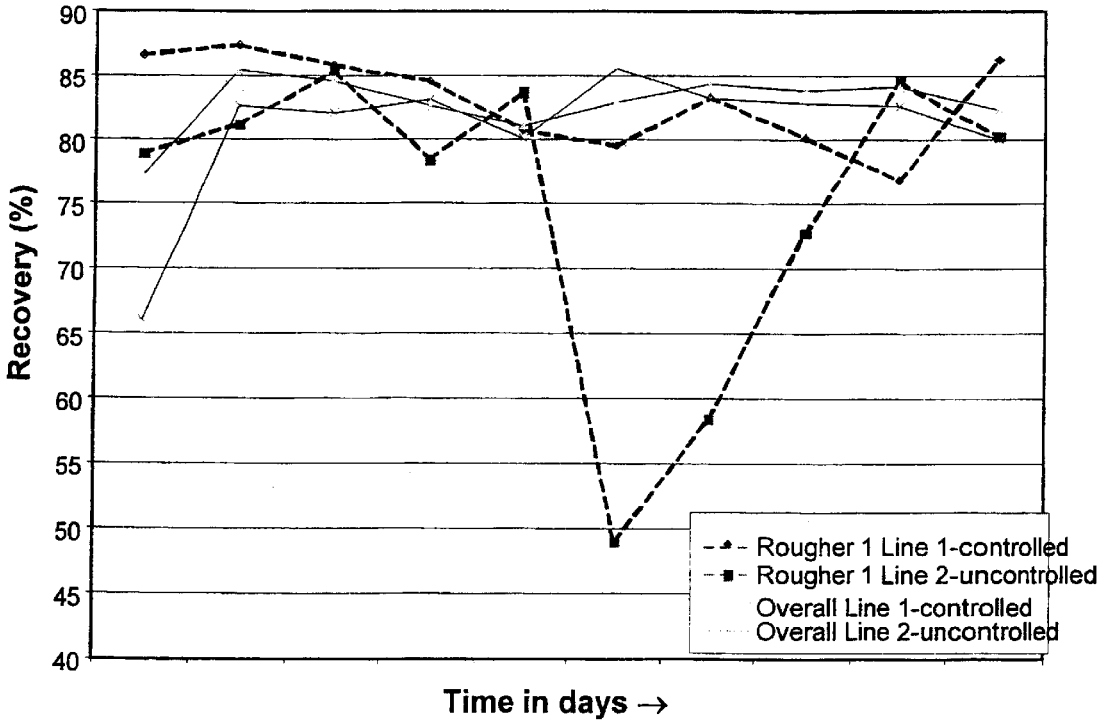
FIG. 9 the copper recovery results over a 10-day period.

The recovery from the cells under control of the new controller (i.e. the first rougher circuit of line 1) was also found to be better than the recovery from the corresponding cells in line 2, probably because of the increased stability of the controlled circuit. Another reason could be the fact that the controller on line 1 was able to maintain a concentrate grade that was closer to the setpoint (the setpoint grade was lower than the average concentrate grade obtained on either line). The recovery improvement in the first rougher circuit was much greater than the improvements over the whole line, which illustrates the importance of having an arrangement in accordance with the invention on all cells in a bank in order to obtain optimal control. This is illustrated in FIG. 9.

A further benefit obtained from the controller was the fact that it is designed to reduce frother consumption. Over the period of the testing, the average frother consumption for line 1 was 7.1% lower than for line 2. This leads to significant savings in the reagent costs for the plant.

The overall benefits in terms of grade and recovery improvement, as well as reduction in frother consumption for line 1 over line 2 are given in the Table 2 below. These confidence levels for these improvements as calculated by the F-test method (a widely used statistical method) indicate the success and reliability of the testwork results. The confidence limits for the recoveries and frother usage will most probably improve, as more data becomes available.

TABLE 2

| | Benefits obtained | |
|---|---|---|
| Performance indicator | Improvement In Line 1 over Line 2 | Confidence Level (F-test) |
| Grade control improvement | 8.66% | 99% |
| Overall Cu Recovery Improvement | 2.34% | 81% |

TABLE 2-continued

| Performance indicator | Benefits obtained: Improvement In Line 1 over Line 2 | Confidence Level (F-test) |
|---|---|---|
| Overall Au Recovery Improvement | 1.78% | 54% |
| Rougher 1 Cu Recovery Improvement | 7.86% | 94% |
| Rougher 1 Au Recovery Improvement | 4.69% | 73% |
| Average frother reduction | 7.10% | 60% |

Flotation plants hitherto have been operated by capable trained operators running the float based on the appearance of the froth. The reason is that the froth actually becomes the product. The froth appearance is a manifestation of all the complex mechanisms that take place in the pulp phase.

Operators interpret the froth appearance differently. Changing the froth appearance every shift results in instability and ultimately poor results due to the operators applying a different interpretation after shift change-over. The arrangement in accordance with the invention assists in providing a continuous uniform interpretation of the froth appearance.

The arrangement utilises cutting edge image processing technology to ensure an accurate and robust system. Various units can be placed at different points in the flotation circuit. This enables capture of the dynamic and inter-circuit relationships and not only observations of a certain part of the circuit.

The only regular service that has to be done on the arrangement would be to clean the glass window of the camera and to replace the light bulb in the external light source.

All electronic components of the arrangement are housed in an environmentally sealed housing and both electrical connections are made in an environmentally sealed connection box.

The information received from the arrangement is useful in the following manner:

1. Operators can be warned when the froth speed moves outside of pre-set limits, so that cell levels and aeration rates can be adjusted.
2. The correlation between speed and grade/recovery over extended periods can be monitored in order to run a plant at a better average grade/recovery.
3. A sensor is provided for use in a close loop control of levels and air.
4. Mass-pull over different parts of the circuit are monitored and maintained.
5. Cells, which are far from a control room or out of reach of an operator, are monitored.

The system can be applied usefully in all types of flotation operations as well as any other application where the detection of movement (or lack of movement) is important.

The arrangement is adapted to measure average velocity of any general texture in a rectangle of interest of approximately 200×500 mm. It is adapted to ignore all "lateral" movement, taking only into account movement towards the longer side of the area of interest (movement perpendicular to the cell lip).

In one application, the following characteristics apply:

1. Optimal texture: mineral froth with bubble sizes between 5 mm and 200 mm.
2. Optimal distance: 1,2 metre.
3. Speed range: 1–0.25 metre per second.
4. Accuracy: ±5% average over 1 minute.
5. Analog output: either 0–10V or 4–20 mA, in linear correspondence with speed.
6. Lighting conditions: full sunlight on the froth to complete darkness (e.g. at night).
7. Power requirements including lighting: either 230 Vac @ 50 Hz or 115 Vac @ 60 Hz, 800 W.

The arrangement has as purpose to monitor and control the performance of a flotation plant using visual information about the appearance of the froth phase.

The arrangement is adapted to identify when the performance of the float is poor and then advise the operators of the most suitable control actions via a decision support interface or implement automatic close loop control.

The arrangement is adapted to calculate new controller settings based on information about the froth appearance.

| List of Reference numerals | |
|---|---|
| 10 | arrangement |
| 12 | housing |
| 14 | power supply unit |
| 16 | conductors |
| 18 | camera |
| 20 | computer |
| 22 | output circuitry |
| 24 | conductors |
| 26 | conductors |
| 28 | conductors |
| 30 | conductors |
| 32 | conductors |
| 34 | output values |
| 36 | output values |
| 38 | display |
| 40 | control units |
| 42 | light source |
| 44 | froth flotation cell |
| 46 | agitator shaft |

What is claimed is:

1. Apparatus for monitoring a froth flotation cell of a flotation plant, the apparatus including:

an optical observation means for acquiring a series of digital images of froth in the flotation cell and emitting corresponding digital image signals, a computer for processing the digital image signals emitted by the optical observation means, calculating parameter values of a froth characteristic of froth in the flotation cell based on the digital image signals, and emitting a parameter signal representative of the calculated parameter values, and a display means for displaying the parameter signal emitted by the computer, wherein the froth characteristic is selected from the group consisting of froth speed, froth stability and bubble size.

2. Apparatus according to claim 1, comprising a means for converting the parameter signal emitted by the computer to an analog industrial standard.

3. Apparatus according to claim 1, comprising a means for converting the parameter signal emitted by the computer to a digital industrial standard.

4. Apparatus for monitoring and controlling a froth flotation cell of a flotation plant, the apparatus including:

an optical observation means for acquiring a series of digital images of froth in the flotation cell and emitting corresponding digital image signals, a computer for processing the digital image signals emitted by the optical observation means, calculating parameter values of a froth characteristic of froth in the flotation cell based oil thie digital image signals, emitting a parameter signal representative of the calculated parameter values, and generating a control signal in response to the parameter signal, and a control means responsive to the control signal for effecting variation in the froth characteristic of froth in the flotation cell, wherein the froth characteristic is selected from the group consisting of froth speed, froth stability and bubble size.

5. Apparatus according to claim 4, comprising a means for converting the parameter signal emitted by the computer to an analog industrial standard.

6. Apparatus according to claim 4, comprising a means for converting the parameter signal emitted by the computer to a digital industrial standard.

7. Apparatus according to claim 4, wherein the froth characteristic is froth speed and the control means is operative to effect variation in froth speed by changing a process variable selected from the group consisting of pulp level, aeration rate and frother dosage.

8. Apparatus according to claim 7, comprising an on-stream analyzer for measuring concentrate grade and wherein the computer is responsive to the on-stream analyzer to increase a froth speed setpoint in the event concentrate grade is higher than a desired grade and to decrease the froth speed setpoint in the event the concentrate grade is lower than the desired grade.

9. Apparatus for monitoring and controlling a froth flotation cell of a flotation plant, the apparatus including:

an optical observation means for acquiring a series of digital images of froth in the flotation cell and emitting corresponding digital image signals, a computer for processing the digital image signals emitted by the optical observation means, calculating parameter values of a froth characteristic of froth in the flotation cell based on the digital image signals, emitting a parameter signal representative of the calculated parameter values, and generating a control signal in response to the parameter signal, a display means for displaying the parameter signal emitted by the computer, and a control means responsive to the control signal for effecting variation in the froth characteristic of froth in the flotation cell, wherein the froth characteristic is selected from the group consisting of froth speed, froth stability and bubble size.

10. Apparatus according to claim 9, comprising a means for converting the parameter signal emitted by the computer to an analog industrial standard.

11. Apparatus according to claim 9, comprising a means for converting the parameter signal emitted by the computer to a digital industrial standard.

12. Apparatus according to claim 9, wherein the froth characteristic is froth speed and the control means is operative to effect variation in froth speed by changing a process variable selected from the group consisting of pulp level, aeration rate and frother dosage.

13. Apparatus according to claim 12, comprising an on-stream analyzer for measuring concentrate grade and wherein the computer is responsive to the on-stream analyzer to increase a froth speed setpoint in the event concentrate grade is higher than a desired grade and to decrease the speed setpoint in the event the concentrate grade is lower than the desired grade.

14. A method of monitoring operation of a froth flotation cell of a flotation plant, comprising:

acquiring a series of digital images of froth in the flotation call, processing the digital images and generating therefrom a parameter signal that represents a calculated value of a froth characteristic of froth in the flotation cell, and displaying the calculated value of the froth characteristic, wherein the froth characteristic is selected from the group consisting of froth speed, froth stability and bubble size.

15. A method according to claim 14, comprising a means for converting the parameter signal to an analog industrial standard.

16. A method according to claim 14, comprising a means for converting the parameter signal to a digital industrial standard.

17. A method according to claim 14, comprising generating a control signal that represents difference between the calculated value of the froth characteristic and a setpoint of the froth characteristic and effecting variation in the froth characteristic in response to the control signal to reduce said difference.

18. A method of monitoring operation of a froth flotation cell of a flotation plant, comprising:

acquiring a series of digital images of froth in the flotation cell, processing the digital images and generating therefrom a parameter signal that represents a calculated value of a froth characteristic of froth in the flotation cell, generating a control signal that represents difference between the calculated value of the front characteristic and a setpoint of the froth characteristic and effecting variation in the froth characteristic in response to the control signal to reduce said difference, and effecting variation in the froth characteristic in response to the control signal to reduce said difference, wherein the froth characteristic is selected from the group consisting of froth speed, froth stability and bubble size.

19. A method according to claim 18, comprising a means for converting the parameter signal to an analog industrial standard.

20. A method according to claim 18, comprising a means for converting the parameter signal to a digital industrial standard.

21. A method according to claim 18, wherein the froth characteristic is froth speed and the method comprises effecting variation in froth speed by changing a process variable selected from the group consisting of pulp level, aeration rate and frother dosage.

22. A method according to claim 21, comprising measuring concentrate grade of froth discharged from the flotation cell and increasing a froth speed setpoint in the event concentrate grade is higher than a desired grade and decreasing the froth speed setpoint in the event the concentrate grade is lower than the desired grade.

23. A method of monitoring operation of a froth flotation cell of a flotation plant, comprising:

acquiring a series of digital images of froth in the flotation cell, processing the digital images and generating therefrom a parameter signal that represents a calculated value of a froth characteristic of froth in the flotation cell, generating a control signal that represents difference between the calculated value of the froth characteristic and a setpoint of the froth characteristic, displaying the calculated value of the froth characteristic, and effecting variation in the froth characteristic in response to the control signal to reduce said difference, wherein the froth characteristic is selected from the group consisting of froth speed, froth stability and bubble size.

24. A method according to claim 23, comprising a means for converting the parameter signal to an analog industrial standard.

25. A method according to claim 23, comprising a means for converting the parameter signal to a digital industrial standard.

26. A method according to claim 23, wherein the froth characteristic is froth speed and the method comprises effecting variation in froth speed by changing a process variable selected from the group consisting of pulp level, aeration rate and frother dosage.

27. A method according to claim 26, comprising measuring concentrate grade of froth discharged from the flotation cell and increasing a froth speed setpoint in the event concentrate grade is higher than a desired grade and decreasing the froth speed setpoint in the event the concentrate grade is lower than the desired grade.

* * * * *